US010166667B2

(12) United States Patent
Groch

(10) Patent No.: US 10,166,667 B2
(45) Date of Patent: Jan. 1, 2019

(54) STAPLING DEVICE

(71) Applicant: LEITZ ACCO Brands GmbH & Co KG, Stuttgart (DE)

(72) Inventor: Hans-Werner Groch, Stuttgart (DE)

(73) Assignee: LEITZ ACCO Brands GmbH & Co KG, Stuttgart (DE)

( * ) Notice: Subject to any disclaimer, the term of this patent is extended or adjusted under 35 U.S.C. 154(b) by 351 days.

(21) Appl. No.: 15/127,960

(22) PCT Filed: Mar. 2, 2015

(86) PCT No.: PCT/EP2015/054272
§ 371 (c)(1),
(2) Date: Sep. 21, 2016

(87) PCT Pub. No.: WO2015/165612
PCT Pub. Date: Nov. 5, 2015

(65) Prior Publication Data

US 2017/0087699 A1 Mar. 30, 2017

(30) Foreign Application Priority Data

Apr. 30, 2014 (DE) ..... 10 2014 006 230

(51) Int. Cl.
*B25C 5/02* (2006.01)
*B25C 5/11* (2006.01)

(52) U.S. Cl.
CPC ..... *B25C 5/025* (2013.01); *B25C 5/11* (2013.01)

(58) Field of Classification Search
CPC .... B25C 5/0221; B25C 5/0242; B25C 5/0235
See application file for complete search history.

(56) References Cited

U.S. PATENT DOCUMENTS 4,040,556 A 8/1977 Dahle
5,758,813 A 6/1998 Kikuchi et al.
(Continued)

FOREIGN PATENT DOCUMENTS

DE 25 34 178 B1 12/1976
EP 0 761 392 A1 3/1997

OTHER PUBLICATIONS

International Search Report of PCT/EP2015/054272, dated Jun. 9, 2015.

(Continued)

*Primary Examiner* — Andrew M Tecco
*Assistant Examiner* — Praachi M Pathak
(74) *Attorney, Agent, or Firm* — Collard & Roe, P.C.

(57) ABSTRACT

A stapling device extends in a longitudinal direction from a front region to a rear region, having a bottom part having a set-down surface on its underside, having an anvil leg that is mounted so as to be pivotable in a limited manner about a first pivot pin in the front region with respect to the bottom part and carries an anvil plate in the front region, having a staple magazine that is mounted on a bearing block in the rear region so as to be pivotable in a limited manner about a second pivot pin with respect to the anvil leg, having a driver leg that is mounted so as to be pivotable in a limited manner about the second pivot pin with respect to the anvil leg and with respect to the staple magazine and has a driver for guiding staples through a gap at the front end of the staple magazine and for pressing the staples against the anvil plate, and having at least one longitudinally extending lever which is mounted on the bottom part by means of a first bearing in the rear region and on the anvil leg by a second bearing between the front region and the rear region, wherein one of the bearings is a third pivot pin and the other bearing is a floating bearing, and wherein the at least one (Continued)

Figure 2A:
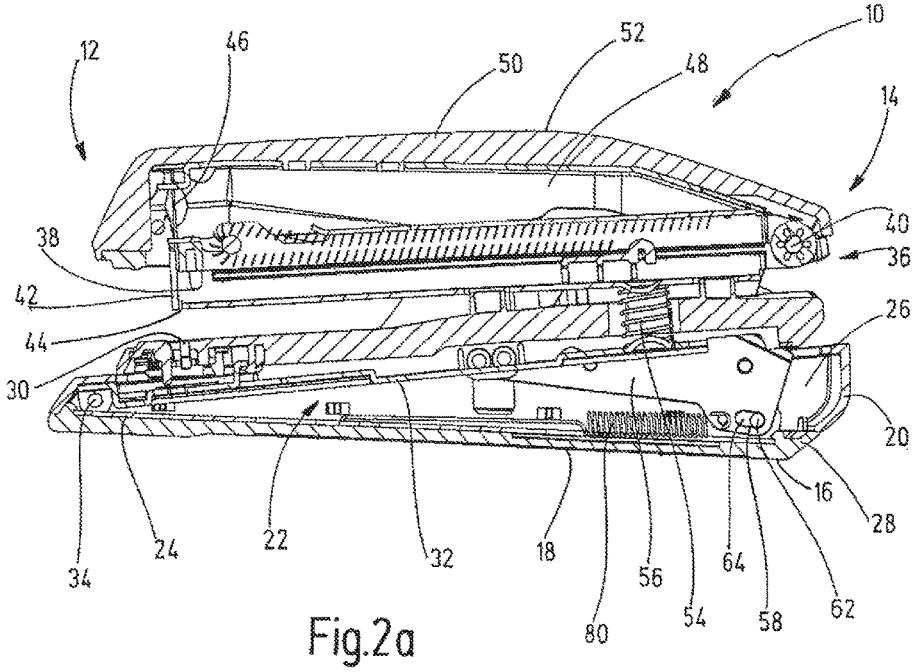

lever is coupled to the driver leg, at the front, end of the lever facing the front region, such that a movement of the front end towards the anvil leg results in a movement of the driver towards the anvil plate.

15 Claims, 2 Drawing Sheets

(56) References Cited

U.S. PATENT DOCUMENTS

| | | | |
|---|---|---|---|
| 2007/0251974 | A1 | 11/2007 | Parrish |
| 2010/0059568 | A1 | 3/2010 | Leung |
| 2010/0059569 | A1 | 3/2010 | Maemori |
| 2010/0108738 | A1 | 5/2010 | Cedar et al. |

OTHER PUBLICATIONS

German Search Report dated Dec. 3, 2014 in DE 10 2014 006 230.9 with an English translation of the relevant parts.

STAPLING DEVICE

CROSS REFERENCE TO RELATED APPLICATIONS

This application is the National Stage of PCT/EP2015/054272 filed on Mar. 2, 2015, which claims priority under 35 U.S.C. § 119 of German Application No. 10 2014 006 230.9 filed on Apr. 30, 2014, the disclosures of which are incorporated by reference. The international application under PCT article 21 (2) was not published in English.

The invention relates to a stapling device.

Known stapling devices have a lower part that has a set-down surface on its underside, for setting the device down onto a tabletop, and forms an anvil leg that extends, in a longitudinal direction, from a front region to a rear region, having an anvil plate in the front region. In the rear region, a staple magazine is mounted on the lower part on a bearing block, so as to pivot in restricted manner, which magazine can be lowered in the front region to such an extent until it lies on the anvil plate or on the documents that lie on the anvil plate. Furthermore, a driver leg is mounted on the bearing block, so as to pivot in restricted manner relative to the lower part and the staple magazine, which leg carries a driver in the front region, which driver, when lowered, applies force to the staple situated at the front in the staple magazine and presses it through a gap in the bottom of the staple magazine, so that the staple penetrates the documents lying on the anvil plate and is deformed by means of the anvil plate. Such previously known stapling devices are produced in different embodiments and have proven themselves outstandingly for decades. In order to be able to apply sufficiently great force during stapling, however, it is generally necessary to press on the driver leg as far forward as possible when pressing it down.

It is therefore the task of the invention to develop a stapling device that is easier to handle.

This task is accomplished, according to the invention, by means of a stapling device having the characteristics of claim 1. Advantageous further developments of the invention are the object of the dependent claims.

The invention is based on the idea that during stapling, pressure on the driver leg does not necessarily have to be exerted as far as possible to the front, but rather, the pressure can also be exerted on the driver leg in the central or even the rear region, because of the pivotable mounting of the anvil leg that is held in the lower part, which part is immovably fixed in place during the stapling process. Furthermore, the force that the user must apply during stapling is less than in the case of most conventional stapling devices.

It is advantageous if the first bearing, with which the at least one lever is mounted on the lower part in the rear region, has a pin as well as an oblong hole that extends in the longitudinal direction, in which hole the pin is guided. In this regard, it is possible that the pin is connected with the lower part in fixed manner and the oblong hole is disposed in the lever, or vice versa, that the pin is connected with the lever in fixed manner and the oblong hole is disposed in the lower part. In this embodiment of the first bearing, the second bearing, with which the at least one lever is mounted on the anvil leg between the front region and the rear region, is configured as a pivot axle. It is advantageous if the oblong hole is closed at both its ends, so that the lever can be moved only in restricted manner, in that the two ends of the oblong hole form stops for the pin.

It is practical if the lower part has a trough having a bottom and at least one side wall that extends in the longitudinal direction and stands upward from the bottom, which wall, depending on the exemplary embodiment, is provided either with the pin or with the oblong hole of the first bearing. It is preferred that the trough has two side walls that run parallel to and at a distance from one another, particularly if two levers are present. The trough can be produced from sheet metal, wherein then, it is advantageous if it is accommodated in a plastic sheathing and is not visible from the outside for an observer, at least for the most part. However, it is also possible to structure the trough as a plastic part, in one piece, for example as an injection-molded part. If the pin of the first bearing is disposed on the trough, then it can be molded on in one piece made of plastic, or can be attached to the trough as a separate component, for example made of metal.

According to a first exemplary embodiment, the at least one lever is coupled with the driver leg in such a manner that a force transfer element firmly coupled with the one component lies against the other component at a beveled edge that is inclined relative to the vertical and relative to the horizontal. In this regard, it is preferred that the force transfer element is a roller that is rigidly or rotatably attached to the driver leg or to the lever. It is practical if the at least one lever has a beveled edge that is inclined relative to the vertical and relative to the horizontal at its front end, against which edge the force transfer element firmly connected with the driver leg lies.

In the first exemplary embodiment, it is preferred that the beveled edge has an inclination, relative to the horizontal, that varies over its length, in such a manner that during penetration of a staple into paper to be stapled, which lies on the anvil plate, and during bending of the free ends of a staple on the anvil plate, the force transfer element makes contact at a part having a lesser inclination than during lowering of the staple magazine and during separation of a staple from a staple stick accommodated in the staple magazine. This takes into account the fact that greater force must be applied to the staple during penetration into the paper and during bending of the free ends than during lowering of the staple magazine and during separation of the staple.

According to a second exemplary embodiment, the at least one lever forks, at its front end, into an upper and a lower front part, and a force transfer element firmly connected with the driver leg is disposed in an interstice between the upper and the lower front part, which element in turn can be a roller rigidly or rotatably attached to the driver leg. This roller is compulsorily guided between the upper and the lower front part, so that lowering of the front lever end also brings with it lowering of the driver leg, while raising of the front lever end has the result of raising of the driver leg.

It is practical if the stapling device has two levers having the same construction, disposed parallel to and at a distance from one another, of which each is mounted on the lower part by means of a first bearing and on the anvil leg by means of a second bearing and is coupled with the driver leg at its front end. It is practical if the two levers are disposed symmetrically relative to one another with reference to a longitudinal center plane, so that the mounting on the lower part and on the anvil leg as well as the coupling with the driver leg should also be carried out symmetrically. Because of the placement of two levers, the force in the stapling device is distributed more uniformly.

It is practical if the driver leg has a cover that covers the staple magazine, which cover has a gripping surface for a user at its top. The cover cap can be produced from plastic, for example, and can have rounded edges, so that the user does not have to grip metal parts of the driver leg, which might have angular edges, and this increases the ease of use.

If the staple magazine is opened by lifting off the driver leg, in order to be able to put new staples in place, then the at least one lever is uncoupled from the driver leg. In order to prevent the front end of the at least one lever from folding away downward, preferably at least one coupling element is provided, which applies a counterforce to prevent a downward movement of the front end of the at least one lever. The coupling elements can be sheet-metal continuations that project upward from the magazine, which engage into correspondingly structured holes on an angularly bent transverse flank of the respective lever. According to a preferred embodiment, however, each lever is connected with the lower part by means of a tensile spring that is attached between its back end, which faces the rear region, and the second bearing, and extends in the direction toward the front region, so that the tensile spring applies the counterforce.

Figure 1:
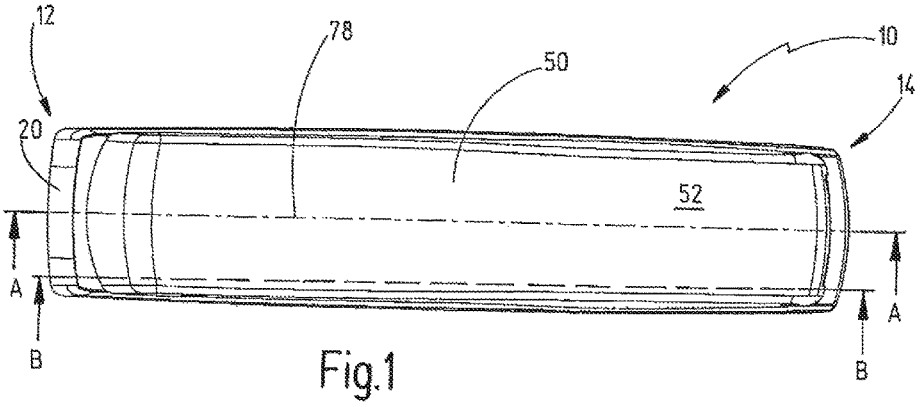
Figure 2B:
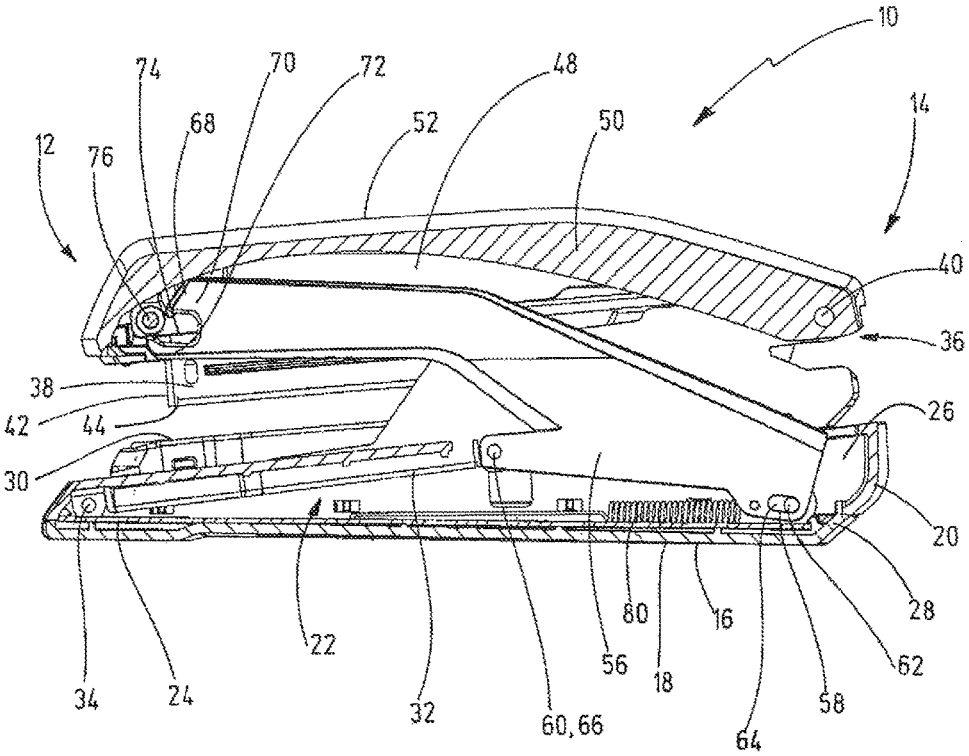
Figure 3:
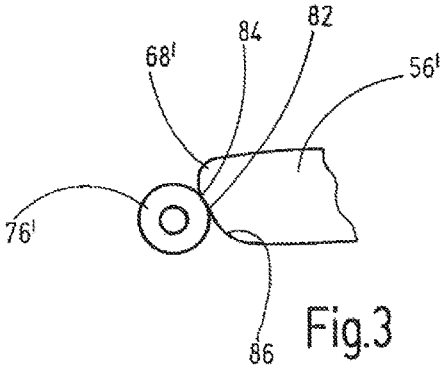

In the following, the invention will be explained in greater detail using two exemplary embodiments shown schematically in the drawing. The figures show:

FIG. 1 a stapling device in a top view;

FIG. 2*a* the stapling device according to FIG. 1 in section along the line A-A;

FIG. 2*b* the stapling device according to FIG. 1 in section along the line B-B, and FIG. 3 an alternative embodiment of the front end of the lever, in a schematic side view.

The stapling device 10 shown in the drawing has an elongated shape and extends, in a longitudinal direction, from a front region 12 to a rear region 14. It has a lower part 20 that has a set-down surface 18 on its underside 16, which part in turn has a trough 22 made of sheet metal, which has a bottom 24 and side walls 26 that extend parallel to and at a distance from one another, in the longitudinal direction, and stand upward from the bottom 24, and is accommodated in a plastic sheathing 28 that has the set-down surface 18.

An anvil leg 32 that carries an anvil plate 30 in the front region 12 is mounted in the lower part 20, so as to pivot about a first pivot axle 34, in restricted manner. In this regard, the first pivot axle 34 is situated farther away from the rear region 14 than the anvil plate 30. A staple magazine 38 is mounted on the anvil leg 32, on a bearing block 36 in the rear region 14, so as to pivot about a second pivot axle 40, in restricted manner. The staple magazine 38 has an underside gap 44 at its front end 42, which gap is disposed above the anvil plate 30 and through which gap the staple accommodated at the front in the staple magazine 38 is passed during the stapling process. A driver leg 48 that carries a driver 46 in the front region 12 is also mounted so as to pivot around the second pivot axle 40, in restricted manner, which leg is covered by a cover cap 50 made of plastic, which cap has a gripping surface 52 for the user of the stapling device 10 at the top. The staple magazine 38 is supported on the anvil leg 32 by means of a first pressure spring 54 at some distance from the bearing block 36, which spring holds the staple magazine 38 at a distance from the anvil plate 30 in the force-free state. At a slightly greater distance from the bearing block 36, the driver leg 48 is supported on the staple magazine 38 by way of a second pressure spring, not shown in the drawing, which spring holds the lower edge of the driver 46 at a distance above the staple accommodated at the front in the staple magazine 38, in the force-free state. In this regard, the first pressure spring 54 and the second pressure spring are coordinated with one another in such a manner that lowering of the driver 46 onto the staple at the front takes place only when the staple magazine 38 is already lying on the anvil plate 30 or on documents lying on the anvil plate 30, in the region of the gap 44.

A lever 56 is disposed on each of the side walls 26, so as to pivot in restricted manner, which lever is mounted on the respective side wall 26 by means of a first bearing 58, lying against the respective side wall 26 on its inner surface that faces the other side wall 26, in each instance, in the rear region 14, and on the anvil leg 32, approximately in the middle between the front region 12 and the rear region 14, by means of a second bearing 60. In this regard, the rearmost of the two levers 56, in the viewing direction, is shown in FIG. 2*a*, and the frontmost of the two levers 56, in the viewing direction, is shown in FIG. 2*b*. In the exemplary embodiment shown, the first bearing 58 is a floating bearing, in which a pin 62 that projects from the respective side wall 26 is guided in the respective lever 56, in an oblong hole 64 that is closed at its two ends. The second bearing 60 is a third pivot axle 66.

At its front end 68, each of the levers 56 forks into an upper front part 70 and a lower front part 72, between which an interstice 74 remains clear. A force transfer element firmly connected with the driver leg 48, in the form of a plastic roller 76 rotatably attached to the driver leg 48 engages into the interstice 74 of each of the levers 56. The roller 76 serves for force transfer from the lever 56 to the driver leg 48, and can also consist of a different material for this purpose, and can also be non-rotatably fixed in place on the driver leg 48, so that it can be referred to as a pin. The two levers 56 are disposed symmetrically with reference to a center longitudinal plane 78 through which the section according to FIG. 2*a* passes, just like the rollers 76 and the bearings 58, 60.

A tensile spring 80 that extends toward the front region 12 is attached to each lever 56, close to the oblong hole 64, which spring is attached to the lower part 20 with its other end. Pivoting of the lever 56 about the third pivot axle 66, during which its lower end 68 is lowered, thereby takes place counter to the reset force of the tensile spring 80. The related roller 76 is compulsorily guided in the interstice 74, so that pressing down the cover cap 50 brings about pivoting of the anvil leg 32 about the first pivot axle 34, pivoting of the levers 56 about the third pivot axles 66, and finally, even when pressure is exerted on the cover cap 50 close to the rear region 14, lowering of the driver 46, as well as, on the basis of the interplay of the first pressure spring 54 and the second pressure spring, lowering of the staple magazine 38 onto the anvil plate 30.

In FIG. 3, the front end 68' of a lever 56' is shown schematically in an alternative embodiment. The lever 56' does not demonstrate any forking into an upper and lower front part, but rather has a beveled edge 82, against which the roller 76' that is attached to the driver leg 48 lies. The beveled edge 82 is inclined both relative to the vertical and relative to the horizontal, and has a first part 84, the inclination of which is greater relative to the horizontal than the inclination of a second part 86 disposed underneath the first part 84 and following it. In this way, the fact that when the staple magazine 38 is lowered onto the anvil plate 30, less force is required than during the subsequent penetration by the staple through the documents lying on the anvil plate 30, as well as during deformation of the staple, is taken into account.

In summary, the following should be stated: The invention relates to a stapling device 10, which extends in a longitudinal direction from a front region 12 to a rear region 14, having a lower part 20 that has a set-down surface 18 on its underside 16, having an anvil leg 32 that carries an anvil plate 30 in the front region 12, which anvil leg is mounted in the front region 12 so as to pivot in restricted manner relative to the lower part 20 about a first pivot axle 34, having a staple magazine 38 that is mounted on a bearing block 36 in the rear region 14, so as to pivot about a second pivot axle 40, relative to the anvil leg 32, in restricted manner, having a driver leg 48 that is mounted so as to pivot about the second pivot axle 40 in restricted manner, relative to the anvil leg 32 and relative to the staple magazine 38, which driver leg has a driver 46 for guiding staples through a gap 44 at the front end 42 of the staple magazine 38 and for pressing the staples down against the anvil plate 30, and having at least one lever 56, 56' that extends in the longitudinal direction, which lever is mounted on the lower part 20 in the rear region 14, by means of a first bearing 58, and on the anvil leg 32 by means of a second bearing 60 between the front region 12 and the rear region 14, wherein one of the bearings 58, 60 is a third pivot axle 66 and the other bearing is a floating bearing, and wherein the at least one lever 56, 56' is coupled with the driver leg 48, at its front end 68 that faces the front region 12, in such a manner that a movement of the front end 68 toward the anvil leg 32 results in a movement of the driver 46 toward the anvil plate 30.

The invention claimed is:

1. Stapling device, which extends in a longitudinal direction from a front region (12) to a rear region (14), having a lower part (20) that has a set-down, surface (18) on its underside (16), having an anvil leg (32) that carries an anvil plate (30) in the front region (12), which anvil leg is mounted in the front region (12) so as to pivot in restricted manner relative to the lower part (20) about a first pivot axle (34), having a staple magazine (38) that is mounted on a bearing block (36) in the rear region (14), so as to pivot about a second pivot axle (40), relative to the anvil leg (32), in restricted manner, having a driver leg (48) that is mounted so as to pivot about the second pivot axle (40) in restricted manner, relative to the anvil leg (32) and relative to the staple magazine (38), which driver leg has a driver (46) for guiding staples through a gap (44) at the front end (42) of the staple magazine (38) and for pressing the staples down against the anvil plate (30), and having at least one lever (56, 56') that extends in the longitudinal direction, which lever is mounted on the lower part (20) in the rear region (14), by means of a first bearing (58), and on the anvil leg (32) by means of a second bearing (60) between the front region (12) and the rear region (14), wherein one of the bearings (58, 60) is a third pivot axle (66) and the other bearing is a floating bearing, and wherein the at least one lever (56, 56') is coupled with the driver leg (48), at its front end (68) that faces the front region (12), in such a manner that a movement of the front end (68) toward the anvil leg (32) results in a movement of the driver (46) toward the anvil plate (30).

2. Stapling device according to claim 1, wherein the first bearing (58) has a pin (62) firmly connected with the lower part (20) or with the lever (56, 56'), as well as an oblong hole (64) that extends in the longitudinal direction and in which the pin (62) is guided.

3. Stapling device according to claim 2, wherein the oblong hole (64) is closed at its two ends.

4. Stapling device according to claim 2, wherein the lower part (20) has a trough (22) having a bottom (24) and at least one side wall (26) that extends in the longitudial direction and stands upward from the bottom (24), which wall is provided with the pin (62) or with the oblong hole (64) of the first bearing (58).

5. Stapling device according to claim 1, wherein the at least one lever (56') is coupled with the driver leg (48) in such a manner that a force transfer element (76') firmly coupled with the one component (48, 56') lies against the other component (56', 48) at a beveled edge (82) that is inclined relative to the vertical and relative to the horizontal.

6. Stapling device according to claim 5, wherein the force transfer element is a roller (76') rigidly or rotatably attached to the driver leg (48) or to the lever (56').

7. Stapling device according to claim 5, wherein the at least one lever (56') has a beveled edge (82) at its front end (68), which edge is inclined relative to the vertical and relative to the horizontal, against which edge the force transfer element (76') firmly connected with the driver leg (48) lies.

8. Stapling device according to one claim 5, wherein the beveled edge (82) has an inclination, relative to the horizontal, that varies over its length, in such a mariner that during penetration of a staple into paper to be stapled, which lies on the anvil plate (30), and during bending of the free ends of a staple on the anvil plate (30), the force transfer element (76') makes contact at a part (86) having a lesser inclination than during lowering of the staple magazine (38) and during separation of a staple from a staple stick accommodated in the staple magazine (38).

9. Stapling device according to claim 1, wherein the at least one lever (56) forks into an upper and a lower front part (70, 72) at its front end (68), and that a force transfer element (76) firmly connected with the driver leg (48) is disposed in an interstice (74) between the upper and the lower front part (70, 72).

10. Stapling device according to claim 9, wherein the force transfer element is a roller (76) rigidly or rotatably attached to the driver leg (48).

11. Stapling device according to claim 1, comprising two levers (56, 56') having the same construction, disposed parallel to and at a distance from one another, of which each is mounted on the lower part (20) by means of a first bearing (58) and on the anvil leg (32) by means of a second bearing (60) and is coupled with the driver leg (48) at its front end (68).

12. Stapling device according to claim 11, wherein the two levers (56, 56') are disposed symmetrically relative to one another with reference to a center longitudinal plane (78).

13. Stapling device according to claim 1, wherein the driver leg (48) has a cover cap (50) that covers the staple magazine (38) and has a gripping surface (52) for a user at its top.

14. Stapling device according to claim 1, comprising at least one coupling element, which opposes a downward movement of the front end (68) of the at least one lever (56, 56') with a counterforce.

15. Stapling device according to claim 1, wherein each of the levers (56) is connected with the lower part (20) by means of a tensile spring (80) that is attached between the back end of the lever (56) that faces the rear region (14) and the second bearing (60), and extends in the direction toward the front region (12).

* * * * *